US005311831A

United States Patent [19]

Fieschi

[11] Patent Number: 5,311,831

[45] Date of Patent: May 17, 1994

[54] DEVICE FOR REVERSAL OF AN END-OF-STITCHING CHAIN IN A TWO-NEEDLE OVEREDGING TRIMMING MACHINE

[76] Inventor: Giorgio Fieschi, Rimoldi S.r.l. Via Montebello, 33 Olcella Di Busto Garolfo, Milano, Italy

[21] Appl. No.: 65,599

[22] Filed: May 21, 1993

[30] Foreign Application Priority Data

Jul. 22, 1992 [IT] Italy ..... MI92A001769

[51] Int. Cl.[5] ..... D05B 65/00

[52] U.S. Cl. ..... 112/262.1; 112/288

[58] Field of Search ..... 112/288, 287, 253, DIG. 1, 112/DIG. 3, 262.1

[56] References Cited

U.S. PATENT DOCUMENTS 4,149,478 4/1979 Sanvito et al. ..... 112/288 X
4,303,030 12/1981 Palacino et al. ..... 112/288 X
4,829,920 5/1989 Dippert et al. ..... 112/288
4,834,009 5/1989 Van Eyk ..... 112/288
5,119,747 6/1992 Nishiura et al. ..... 112/288

*Primary Examiner*—Clifford D. Crowder
*Assistant Examiner*—Paul C. Lewis
*Attorney, Agent, or Firm*—Laff, Whitesel, Conte & Saret

[57] ABSTRACT

In a trimming sewing machine a chain (16) is formed on a workpiece (5) at the end of a stitching, which chain must be then cut and reversed over the needle plate (2) before starting of new stitching. The chain (16) is formed on a primary tab (12) provided on a side edge (11) of the needle plate (2) and an auxiliary tab (13) disposed parallel to and in side by side relation with the primary tab (12). A chain-cutting member (17) draws the chain (16) in, disengaging it from the auxiliary tab (13) and separates it from the sewn workpiece (5). A first nozzle (20) oriented perpendicular to the sewing direction reverses the cut chain (16) over the needle plate (2). Simultaneously, a second nozzle (22) is activated and it projects an air blow towards the end (13a) of the auxiliary tab (13) so that the chain (16) on reversal is prevented from stepping over the auxiliary tab (13).

4 Claims, 1 Drawing Sheet

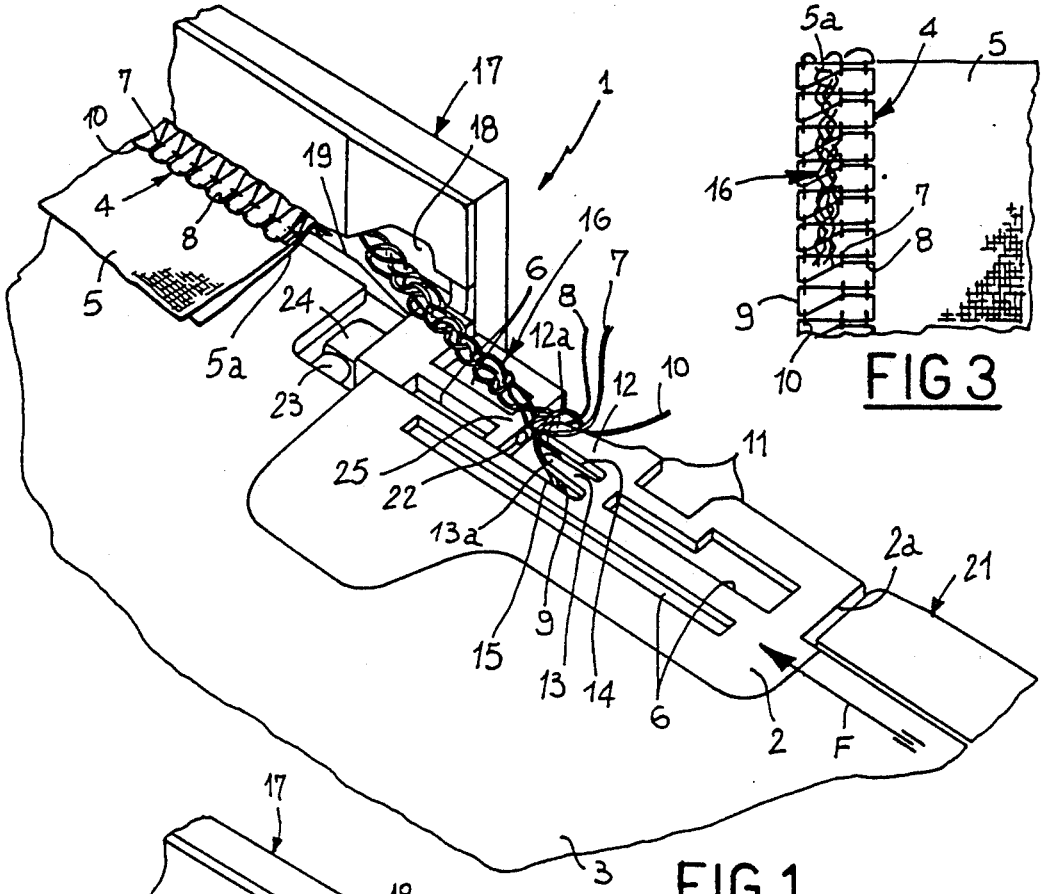
FIG 1
FIG 3
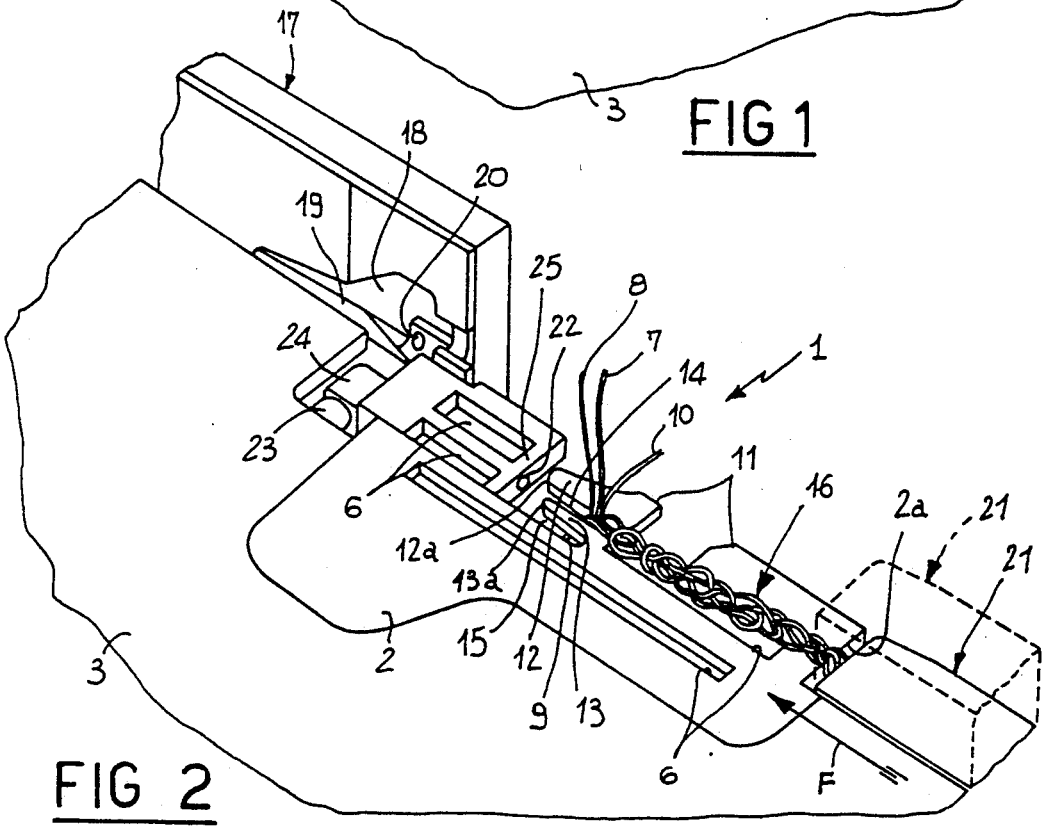
FIG 2

DEVICE FOR REVERSAL OF AN END-OF-STITCHING CHAIN IN A TWO-NEEDLE OVEREDGING TRIMMING MACHINE

BACKGROUND OF THE INVENTION

1. Field of the Invention

The present invention relates to a device for reversal of an end-of-stitching chain or "end chain" in a two-needle overedging machine in which said end chain extending from an end edge of a sewn workpiece is formed about a primary tab provided parallel to the sewing direction on an inner side edge of a needle plate and exhibiting one free end oriented in the sewing direction, as well as about an auxiliary tab exhibited by the needle plate itself at a parallel side by side position relative to the primary tab and having one respective free end oriented in the sewing direction, said device comprising a suction chain-cutting member operatively disposed in the extension of the side edge of the needle plate, immediately downstream of said needle plate with reference to the sewing direction and arranged to draw in and cut the end chain for separating it from the sewn workpiece; a primary nozzle disposed laterally in the extension of the side edge of the needle plate and arranged to produce a first air blow substantially perpendicular to the sewing direction for causing reversal of the end chain thereby orienting it in a direction opposite that of sewing; a grip member operatively located before a front edge of the needle plate for retaining the reversed end chain upon the action of the primary nozzle.

The invention also relates to a process for reversing an end chain put into practice by the above device, said process being of the type comprising the steps of: drawing in and cutting the end chain in a suction chain-cutting member operating in the extension of a side edge of the needle plate, downstream of said needle plate with reference to the sewing direction; reversing the cut chain over the needle plate through 180° by a first blow substantially perpendicular to the sewing direction; holding the cut chain end at a front edge of the needle plate.

2. Prior Art

It is known that in sewing machines of the trimming type for industrial use adapted to carry out a two-needle overedging, the seam is formed by interlacing of several threads respectively carried by the needles, a lower looper and an upper looper.

Interlacing of said threads occurs about a pair of tabs formed in the needle plate, extending parallel to the sewing direction and exhibiting respective free ends oriented in the workpiece feed direction. More particularly, a primary tab is provided which is formed close to a side edge of the needle plate, as well as an auxiliary tab disposed parallel to and in side by side relation with the primary tab. Defined between the primary and auxiliary tabs is a first notch in which when the machine is in operation, one of the needles is alternately inserted and exactly the needle identified as "inner needle", that is the needle located more close to the side edge of the needle plate. The other needle or "outer needle" alternately enters a second notch disposed alongside the auxiliary tab on the opposite side from the first notch.

During the stitching step, the workpiece edges are passed through by the needles and interlooped in the stitches as they are formed about the primary and auxiliary tabs.

When, at the end of the sewing operation, the end edge of the workpiece surpasses the sewing area in the provisional step preceding the machine stopping, an end-of-stitching chain is formed that consists of chain stitches not interlooped in the workpiece.

A suction chain-cutting member operatively disposed in the extension of the side edge of the needle plate, downstream of said plate, carries out suction and cutting of the chain, so as to separate it from the sewn workpiece. The cut chain length extending from the primary and auxiliary tabs, must be then reversed over the needle plate in a direction opposite the stitching direction, so that it may be arranged for insertion in the initial length of the following stitching made on a new workpiece edge. To this end, combined with the chain-cutting member is a nozzle designed to eject an air blow oriented perpendicular to the sewing direction so as to cause the chain reversal by rotation through 180° in a substantially horizontal plane. The reversed chain end is engaged by a grip member holding it against the front edge of the needle plate, until starting of a new stitching.

The foregoing being stated, it is noted that in sewing machines set up for carrying out a two-needle overedge stitching the presence of two tabs in the needle plate creates some problems in that, on reversal, the chain could undesirably get entrapped in the auxiliary tab and, at the end of reversal, take an inadequate position in view of its correct insertion in the initial length of the following stitching.

In order to solve this problem, many devices have been developed that carry out retraction of the auxiliary tab in the opposite way with respect to the sewing direction on stopping of stitching, before the chain reversal is operated.

For example, one of these devices is described in European Patent No. 0037444.

In this device the auxiliary tab is located at the end of a drive rod slidably guided in a longitudinal groove formed in the needle plate. An actuator driven by an electronic control unit interlocked to the sewing machine, acts on the drive rod for retracting the auxiliary tab in a direction opposite that of sewing, during the stopping step of the sewing machine. In this manner, the auxiliary tab is slipped off the stitches formed thereon, which ensures that at the end of reversal said chain can extend on the needle plate starting from the extremity of the first notch disposed alongside the primary tab without the risk that it may undesirably step over the auxiliary tab or get entrapped thereby.

As can be easily supposed, the necessity of arranging different kinematic mechanisms for driving the forward and backward movement of the auxiliary tab in synchronism with the operation of the sewing machine involves important problems in terms of structural complexity. It is necessary in fact to arrange several moving mechanical members within the limited room available under the needle plate.

In addition, the presence of these mechanical members makes it practically unfeasible or at all events very hard to carry out the replacement of the needle plate for making the sewing machine adapted to execute stitchings different from the two-needle overedging one.

In fact the removal and replacement of the needle plate requires the complete disassembling of the device controlling the auxiliary tab movements or at least disabling of said device by removal of several mechanical parts.

it is also to be considered that the space taken up by the members designed to control the movements of the auxiliary tab cannot be utilized for the installation of possible other auxiliary devices designed to adapt the machine to execute particular workings.

SUMMARY OF THE INVENTION

Accordingly, the main object of the present invention is to solve the above described problems, by providing a device for reversal of the end chain which is capable of ensuring a precise positioning of the chain itself at the end of the chain reversal without necessarily requiring retraction of the auxiliary tab under the needle plate.

The foregoing and further objects that will become more apparent in the course of the present description are substantially attained by a device for reversal of an end-of-stitching chain in a two-needle overedging machine, further comprising at least one auxiliary nozzle operatively associated with the needle plate and oriented in an opposite direction with respect to the stitching direction for projecting a second air blow towards the free end of the auxiliary tab, so that the cut chain disengaged from the auxiliary tab by effect of the suction action produced by the chain-cutting member and reversed by the first air blow, is engaged by effect of the second air blow in a first notch defined between the primary and auxiliary tabs.

Still in accordance with the present invention, this device puts into practice a process for reversing an end-of-stitching chain in a two-needle overedging machine, wherein during the chain reversal a second air blow is produced which is substantially projected towards the end of the auxiliary tab in an opposite direction with respect to the sewing direction, for inserting the chain into a first longitudinal notch defined in the needle plate between the auxiliary and primary tabs, said chain being previously slipped off the auxiliary tab by effect of suction produced by the chain-cutting device.

BRIEF DESCRIPTION OF THE DRAWINGS

Further features and advantages will be better understood from the detailed description of a preferred embodiment of a device for reversal of an end chain in a two-needle overedging machine, and a reversing process put into practice by the above device in accordance with the present invention. This description will be taken hereinafter by way of non-limiting example with reference to the accompanying drawings in which:

FIG. 1 diagrammatically shows in a perspective fragmentary view, the device in question in a step of drawing in and cutting the end chain;

FIG. 2 shows the device having the end chain reversed over the needle plate and held against a front edge thereof;

FIG. 3 is a fragmentary bottom view of a workpiece portion wherein an end chain is integrated in the initial stitching length subsequently produced on the workpiece itself.

DESCRIPTION OF THE PREFERRED EMBODIMENT

Referring to the drawings, a device for reversal of an end chain in a two-needle overedging machine in accordance with the present invention has been generally identified by reference numeral 1.

The device 1 operates at a needle plate 2 conventionally located flush with a workpiece supporting table 3 of a sewing machine of the trimming type, not shown in the drawings as known per se and not of importance to the ends of the invention. The sewing machine is arranged to execute a two-needle overedge stitching on a workpiece 5 moved forward according to arrow F on the workpiece supporting table 3 by feed dogs not shown in the drawings, operating through corresponding openings 6 arranged in the needle plate 2.

The stitching 4 in the embodiment shown is formed by interlacing a first and a second needle thread 7, 8 respectively carried by an inner needle and an outer needle disposed parallelly in side by side relation and carrying out a reciprocating motion through the needle plate 2, a lower cover thread 9 carried by a lower looper movable transversely to the sewing direction F under the needle plate 2, and an upper cover thread 10 carried by an upper looper alternately operated astride of a side edge 11 of the needle plate. The needles and loopers are not shown as known and not of importance to the ends of the invention.

Interlacing of the threads 7, 8, 9 and 10 is carried out about a primary tab 12 formed at the side edge 11 of the needle plate 2 extending parallel to the sewing direction F and exhibiting a free end **12*a* oriented in the sewing or feed direction of the workpiece 5, as well as about an auxiliary tab 13 disposed parallelly in side by side relation with the primary tab 12 and exhibiting a corresponding free end 13*a* oriented in the sewing direction. A first longitudinal notch 14 is defined between the primary and auxiliary tabs, 12 and 13, alternately entered by the inner needle carrying the first needle thread 7. The outer needle carrying the second needle thread 8 in turn enters a second notch 15 disposed alongside the auxiliary tab 13 on its opposite side from the first notch 14**.

During stitching, the workpiece 5 moving on the needle plate 2 in the sewing direction F is passed through by the needles so that its side edge previously trimmed by known cutting means operating flush with the side edge 11 of the needle plate 2, is interlooped in the stitches formed about the tabs 12, 13. The stitches engaged to the workpiece 5 are slipped off the tabs 12, 13 as the workpiece moves forward.

When, at the end of a stitching, the end edge **5*a* of the workpiece 5 is beyond the sewing area and therefore the tabs 12, 13, an end-of-stitching chain 16** is formed during the slowing down step preceding stopping of the machine, which end chain consists of stitches formed about the tabs but not interlooped in the workpiece.

This chain 16 must be separated from the workpiece 5 and reversed over the needle plate 2 so that it may be incorporated, as shown in FIG. 3, in the next stitching produced during a subsequent work cycle.

To this end, the device 1 comprises a suction chain-cutting member 17 operatively disposed downstream of the needle plate 2 in the extension of the side edge 11 thereof. In known and conventional manner, the chain-cutting member 17 draws the end chain 16 in, inside a suction opening 18, in timed relationship with the passage of the end edge **5*a* of the workpiece 5 before the suction opening. The chain 16 drawn into the suction opening 18 is cut at the end edge 5*a* of the workpiece 5, by a cutting blade 19** known per se.

Advantageously, the suction effect produced by the chain-cutting member on the chain 16 causes the last done stitches formed about the tabs 12, 13 before stopping of the sewing machine to be slipped off the tabs 12, 13 by virtue of a tensioning action consequently produced along the chain itself.

Associated with the suction chain-cutting member 17 is at least one nozzle 20 substantially oriented in a direction perpendicular to the sewing direction F. The first nozzle 20 serves to project a first air blow onto the needle plate 2 so that it impinges on the cut chain 16 and causes the reversal of said chain, by a rotation through 180° in a substantially horizontal plane, in a direction opposite that of sewing.

A grip member 21 operatively located before the needle plate and provided with a vertical reciprocating motion as shown by dotted line in FIG. 2, engages the chain 16 at the end of its reversing movement and holds it at a front edge 2*a* of the needle plate, until the beginning of a new stitching operation.

In known manner, suitable means (not described or shown as not of importance to the ends of the invention) may be associated with the grip member 21 for moving the chain 16 sideways thereby deviating it beyond the side edge 11 for the purpose of cutting it to a predetermined length upon the action of the cutting means acting at said side edge.

In the device 1 according to the invention provision is also made for at least one auxiliary nozzle 22 designed to project a second air blow towards the free end 13*a* of the auxiliary tab 13, said blow being substantially parallel to and moving in the opposite direction with respect to the sewing direction F. Preferably, the auxiliary nozzle 22 is made with at least one hole formed in a transverse portion 25 of the needle plate 2, immediately downstream of the primary and auxiliary tabs 12 and 13 with reference to the sewing direction. In greater detail, the axis of the hole 22 is preferably oriented in a direction tangential to the side of the auxiliary tab 13 facing the primary tab 12.

A duct 23 opening into a connector 24 engaged to the rear part of the needle plate 2 connects the auxiliary nozzle 22 to air supply means, not shown as known per se and not of importantce to the ends of the invention. For example, this air supply means can consist of a solenoid valve conventionally located on a feed duct of the first nozzle 20.

Advantageously the second blow produced from the auxiliary nozzle 22 at the same time as the first blow from the first nozzle 20 grazes the auxiliary tab flank facing the primary tab 12 and therefore prevents the chain on reversal from undesirably getting entrapped in the auxiliary tab or even stepping over said auxiliary tab, thereby entering the second notch 15. In fact, when the chain 16 in the progress of its rotation for reversal, tends to step over the auxiliary tab 13, it is immediately impinged on by the air blow from the auxiliary nozzle 22 which makes the chain enter the first notch 14 at once.

One can be sure therefore that at the end of reversal the end chain 16 will be properly engaged in the first notch 14, as shown in FIG. 2, so that when a new stiching starts it will be correctly incorporated thereinto, as shown in FIG. 3.

The present invention attains the intended purposes. In fact, one can be absolutely sure that the end chain on reversal will not step over the auxiliary tab or be entrapped in said tab, and this is achieved without resorting to the aid of any mechanical moving particular. This feature brings about a great structural simplification in the device in question involving important advantages in terms of manufacturing costs and servicing.

The absence of mechanical devices located under the needle plate for retracting the auxiliary tab makes the space under said plate immediately available for housing possible other members of the sewing machine. In addition, the device of the invention greatly simplifies the setting up operations of the sewing machine when stitchings other than a two-needle overedging are to be executed.

In the connection, replacement of the needle plate may be carried out without practically requiring disassembling of any mechanical particulars interlocked to the auxiliary tab 13, as on the contrary happened in the prior art.

While a preferred embodiment has been shown and described, it should be understood that many changes and modifications may be made therein without departing from the scope of the appended claims.

What is claimed is:

1. A device for reversal of an end-of-stitching chain or end chain in a two-needle overedging machine in which said end chain (16) extending from an end edge (5*a*) of a sewn workpiece (5) is formed about a primary tab (12) provided parallel to the sewing direction ("F") on an inner side edge (11) of a needle plate (2) and having a free end (12*a*) oriented in the sewing direction, as well as about an auxiliary tab (13) provided on the needle plate itself (2) at a parallel side by side position relative to the primary tab (12) and having a free end (13) oriented in the sewing direction, said device comprising:

a suction chain-cutting member (17) operatively disposed in an extension of the side edge (11) of the needle plate (2), immediately downstream of said needle plate with reference to the sewing direction and arranged to draw in and cut the end chain (16) for separating it from the sewn workpiece (5);

a primary nozzle (20) disposed laterally in the extension of the side edge (11) of the needle plate (2) and arranged to produce a first air blow substantially perpendicular to the sewing direction ("F") for causing reversal of the end chain (16) thereby orienting it in a direction opposite that of the direction sewing;

a grip member (21) operatively located before a front edge (2*a*) of the needle plate (2) for retaining the reversed end chain (16) upon the action of the primary nozzle (20), further comprising at least one auxiliary nozzle (22) operatively associated with the needle plate (2) and oriented in an opposite direction with respect to the stitching direction for projecting a second air blow towards the free end (13*a*) of the auxiliary tab (13), so that the cut chain (16) disengaged from the auxiliary tab (13) by effect of the suction action produced by the chain-cutting member (17) and reversed by the first air blow, is engaged by effect of the second air blow in a first notch (14) defined between the primary and auxiliary tabs (12 and 13).

2. The device as claimed in claim 1, wherein said auxiliary nozzle (22) consists of a hole formed in the needle plate (2) according to a horizontal axis, oriented in a direction tangential to a flank of the auxiliary tab (13) facing said primary tab (12).

3. The device as claimed in claim 1, wherein said hole (22) opens on a transverse portion (25) defined in the needle plate (2) immediately downstream of the primary and auxiliary tabs (12, 13) with reference to the sewing direction.

4. A process for reversing an end chain in a two-needle overedging machine, in which said end chain (16) extending from an end edge (5*a*) of a sewn workpiece (5) is formed about a primary tab (12) provided parallel to the sewing direction ("F") on an inner side edge (11) of a needle plate (2) and having a free end (12*a*) oriented in the sewing direction, as well as about an auxiliary tab (13) provided on the needle plate itself (2) at a parallel side by side position relative to the primary tab (12) and having a free end (13) oriented in the sewing direction, said process comprising the steps of:

drawing in and cutting the end chain (16) in a suction chain-cutting member (17) operating in the extension of a side edge (11) of the needle plate (2), downstream of said needle plate with reference to the sewing direction ("F");

reversing the cut chain (16) over the needle plate (2) through 180° by a first air blow substantially perpendicular to the sewing direction ("F");

retaining the cut chain (16) end at a front edge (2*a*) of the needle plate (2), and producing during the chain (16) reversal a second air blow substantially projected towards the end (13*a*) of the auxiliary tab (13) in an opposite direction with respect to the sewing direction, for inserting the chain in a first longitudinal notch (14) defined in the needle plate (2) between the auxiliary and primary tabs (13, 12), said chain (16) being previously slipped off the auxiliary tab (13) by effect of suction produced by the chain cutting device (17).

* * * * *